United States Patent [19]

Young

[11] 4,038,794

[45] Aug. 2, 1977

[54] BOOM ASSEMBLY

[75] Inventor: Warren C. Young, Madison, Wis.

[73] Assignee: The Warner & Swasey Company, Cleveland, Ohio

[21] Appl. No.: 626,244

[22] Filed: Oct. 28, 1975

[51] Int. Cl.[2] ..... E04H 12/18; E04G 25/04; B66C 23/62

[52] U.S. Cl. ..... 52/127; 52/118; 52/632; 212/144

[58] Field of Search ..... 52/118, 121, 632, 127; 212/144, 55

[56] References Cited

U.S. PATENT DOCUMENTS 3,481,490 12/1969 Eiler ..... 212/55

FOREIGN PATENT DOCUMENTS 1,531,174 4/1970 Germany ..... 212/55
24,258 10/1910 United Kingdom ..... 52/121

*Primary Examiner*—James L. Ridgill, Jr.

[57] ABSTRACT

An improved boom section has top and bottom walls formed of sloping plate sections or flanges which define peaks between the side walls. The peaked configuration of the bottom wall increases the buckling strength of the bottom wall over the bucking strength obtained with a flat bottom wall. The sloping flanges of the top and bottom walls are disposed at acute angles of between 12° and 19° to horizontal planes. If the slope of the flanges is increased to an angle significantly greater than 19°, the peaks in the top and bottom walls would be disposed relatively far from the central axis of the boom section and would be subjected to excessive stresses upon loading of the boom section. The boom section is advantageously formed with a height-to-width ratio which is greater than 1 and less than 3. Lateral stability of the boom section is promoted by having slider pad forces applied to the bottom wall of the boom section intersect at a point above the center of the boom section and having slider pad forces applied to the top wall of the boom section intersect at a point below the center of the boom section. To facilitate slider pad replacement, access openings are provided in the top walls of the boom sections. The slider pads advantageously move along stainless steel strips on the walls of the boom sections.

20 Claims, 14 Drawing Figures

BOOM ASSEMBLY

BACKGROUND OF THE INVENTION

The present invention relates to a boom assembly and more specifically to a boom assembly in which a section of the boom assembly has sloping top and bottom walls which tend to maximize the overall stability, strength and stiffness of the boom section.

A known crane is provided with boom sections having a generally rectangular cross sectional configuration, in a manner similar to that disclosed in U.S. Pat. No. 3,690,742. This rectangular boom section is provided with horizontal and vertical slider pads to enable the boom section to withstand both vertical and sideward loading. However, difficulty has been encountered in keeping the vertical pads in contact with both sides of the boom section simultaneously since manufacturing tolerances result in the production of booms which do not have exactly constant widths throughout their length. Any sideways motion of one boom section inside of another adds a twisting moment to the load, decreases the overall elastic stability of the boom, and makes an operator's job of precisely positioning a load more difficult. Of course, any wear of a vertical slide pad increases the aforementioned problems.

Another known boom assembly has a generally square cross sectional configuration with slider pads which engage corner sections of the boom in the manner disclosed in U.S. Pat. No. 3,830,376. This boom construction results in relatively high slider pad loading. In addition, the boom section has a square cross-sectional configuration so that the lines of action of the slider pad forces are through the center of the boom section. This results in marginal lateral stability when the boom section is subjected to a vertical main load.

Still another known boom construction is disclosed in U.S. Pat. No. 3,481,490. One of the boom sections of this construction has peaked top wall on which slider pads, i.e. rollers, are mounted. The peaked top wall of this boom section has an enclosed peak angle of 90° so that the sections of the top wall slope at an angle of 45° to a horizontal plane. Due to the relatively large angle of slope of the various sections of the top wall, the peak of the top wall of this known boom section is located a relatively large distance from the central axis about which the boom section is loaded. Therefore, relatively large stresses will be present at the peak of the top wall of the boom section upon loading of the boom. The bottom wall of this known boom section is generally flat and is not peaked. Since the bottom wall of the boom section is loaded in compression, the unpeaked or generally flat configuration of the bottom wall tends to promote a buckling of the bottom wall when it is subjected to relatively large compression forces resulting from the application of a relatively large load to the boom section. In addition, it should be noted that lateral stability of the boom section is impaired since the top slider pad forces intersect above the center of the boom section while the bottom slider pad forces intersect below the center of the boom section.

SUMMARY OF THE PRESENT INVENTION

The present invention provides a boom assembly in which at least one of the boom sections has a cross-sectional configuration which, for the weight and size of the materials utilized to construct the boom section, tends to maximize the strength, stiffness and lateral stability of the boom section. The improved strength, stiffness and lateral stability of the boom section results from a peaked or sloping configuration of the top and bottom walls of the boom section. By providing the top and bottom walls with a peaked or sloping configuration, the slider pad forces provide both vertical and horizontal reaction forces for the boom section. The use of a peaked or sloping configuration for the top and bottom walls provides the necessary geometry to keep the boom section centered within the enclosing boom section when subjected to side forces due to either laterally applied loads or wind forces. The peaked or sloping configuration of the bottom wall of the boom section also increases the buckling strength of the bottom wall under the influence of compression forces.

The slope of the peaked top and bottom walls relative to a horizontal plane is between 12° and 19°. This results in the outermost portions of the top and bottom peaks being relatively close to the central axis of the boom. This prevents the formation of excessive stresses at the peaks of the top and bottom walls upon the application of a load to the boom tending to bend the boom about its central axis.

The peaked or sloping configuration of the top and bottom walls of the boom section results in the slider pad forces having intersecting lines of action. To provide this boom section with lateral stability, the lines of action for the slider pad forces against the top wall of the boom section intersect at a point which is below the intersection of the lines of action for the slider pad forces against the bottom wall of the boom section. Above and below are relative terms and refer to the longitudinal axis of the boom whether it be horizontal or inclined to the horizontal.

Since the elastic stability of the sidewalls of the boom section is inversely proportional to the square of the height-to-thickness ratio of the sidewalls of the boom section, the peaked configuration of the top and bottom walls of the boom section increases the elastic stability of the sidewalls. This is because the height of the sidewalls, for a given overall height and width of the boom section, is decreased by the peaked configuration of the top and bottom walls of the boom section.

The torsional stiffness of a boom construction is directly proportional to the square of the area enclosed by the median line of the enclosing walls and inversely proportional to the integral of the differential perimeter divided by the wall thickness. When this stiffness constant is evaluated for cross-sectional geometries described herein, it is found that the decrease in the height of the sidewalls causes the ratio of the torsional stiffness to the cross-sectional area to increase as the top and bottom slope angles are increased. The increased torsional stiffness for a given boom cross-sectional area and weight contributes to an increase in lateral elastic stability of the boom.

It is contemplated that it will be necessary to replace one or more of the slider pads after the boom assembly has been utilized for a substantial period of time. Replacement of the slider pads on the axially inner end portions of the boom sections is facilitated by providing access openings in the top walls of the boom sections. The position of an access opening is advantageously such as to provide access when the telescoping boom sections are nearly fully closed. Under this condition the slider pad load is minimum and removal of the slider pads is facilitated. During operation of the boom assembly, these access openings are closed by covers having inner surfaces which are engaged by the slider pads as the boom assembly is extended and retracted.

In order to minimize wear of the walls of the boom section by the slider pads, strips of a relatively hard metal are mounted on the boom section walls along the paths of movement of the slider pads. These hard metal strips may advantageously be mounted on the boom section walls with a suitable adhesive and are resistant to corrosion.

Accordingly, it is an object of this invention to provide a new and improved boom assembly which has at least one boom section with a cross-sectional configuration which enables slider pads to apply both horizontal and vertical force components to the boom section to promote stability of the boom section under load, tends to maximize the buckling strength of a bottom wall of the boom section, prevents the formation of excessive stresses in the top and bottom walls of the boom section, tends to reduce the overall height of the sidewalls of the boom section to improve the elastic stability of the boom section sidewalls and promotes overall lateral stability of the boom section.

Another object of this invention is to provide a new and improved boom section having peaked top and bottom walls with a slope of between 12° and 19° relative to a horizontal plane to increase the buckling strength of the walls without the formation of excessive stresses in the peaked portion of the top and bottom walls upon the application of a load to the boom section and to enable the slider pads to engage the sloping bottom outer surfaces of the top and bottom walls to apply both horizontal and vertical force components to the boom section.

Another object of this invention is to provide a new and improved boom assembly in which slider pad forces applied against the top wall of a boom section have lines of action which intersect at a point below the intersection of lines of action for slider pad forces applied against the bottom wall of the boom section.

Another object of this invention is to provide a new and improved boom assembly in which covered openings are provided in the top walls of the boom sections to provide access to slider pads at axially inner end portions of the boom sections.

Another object of this invention is to provide a new and improved boom assembly in which the slider pads move along strips of a relatively hard metal mounted on walls of the boom sections.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
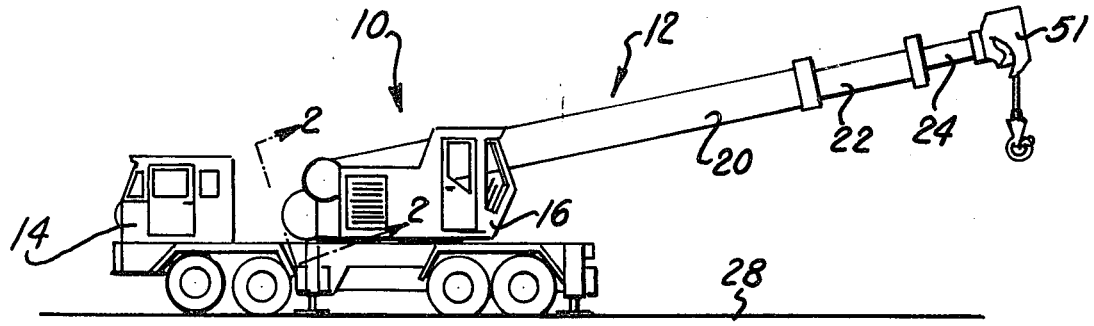
FIG. 1 is a schematic elevational view of a crane having a boom assembly constructed in accordance with the present invention.

A crane 10 having a boom assembly 12 constructed in accordance with the present invention is illustrated in FIG. 1. The crane 10 includes a carrier or truck 14 upon which an operator's cab 16 is pivotally mounted. The boom assembly 12 is mounted for pivotal movement with the cab 16 relative to the truck 14 in a known manner.

Figure 2:
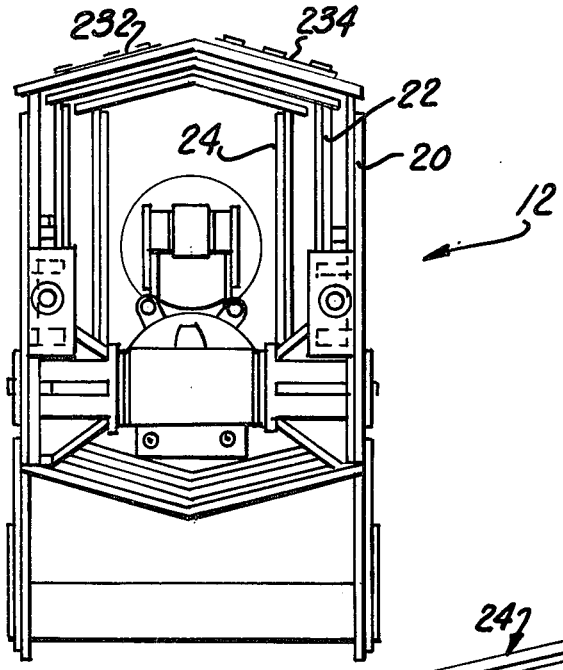
FIG. 2 is a partially broken-away view, taken along the line of 2—2 of FIG. 1, illustrating the telescopic relationship between various sections of the boom assembly.

The boom assembly 12 includes a base section 20, a middle or intermediate section 22 which is telescopically received within the base section 20, and end section 24 which is telescopically received within the intermediate section 22 (see FIG. 2). In order to change the angle of inclination of the boom assembly 12 to the ground 28 or other support surface, a piston and cylinder type hydraulic motor (not shown) is utilized to pivot the base section 20 relative to a rotatable platform upon which the operator's cab 16 and boom assembly 12 are mounted.

Figure 3:
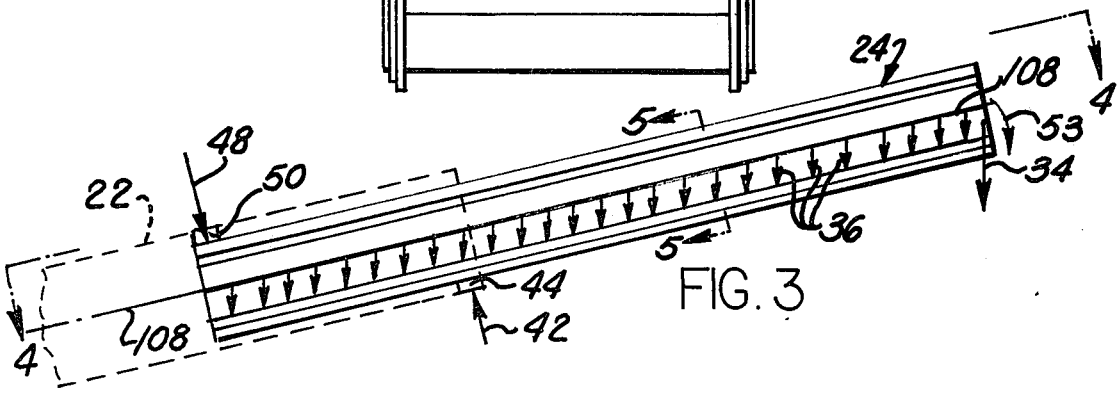
FIG. 3 is a schematic elevational view of one of the boom sections illustrating vertical load forces applied to the boom section.
Figure 4:
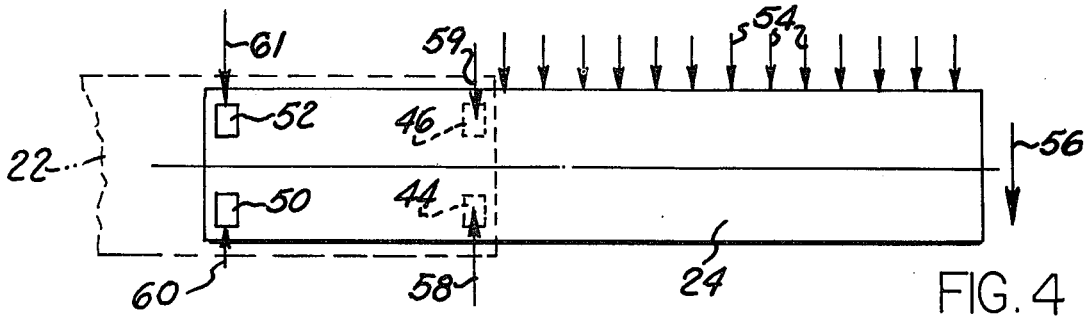
FIG. 4 is a schematic plan view, taken generally along the line 4—4 of FIG. 3; depicting the horizontal load forces to which the boom section is subjected.

The various load forces to which the end section 24 is subjected when the boom assembly 12 is in a loaded condition are illustrated schematically in FIGS. 3 and 4. Thus, the end section 24 is subjected to the rated vertical load and the weight of the head 51 indicated by the arrow 34 in FIG. 3. In addition, the weight of the end boom section 24 provides a uniform downwardly directed force indicated by relatively small arrows 36 in FIG. 3. Upwardly directed forces 42 are applied to the bottom of the boom section 24 at slider pads 44 and 46 (see FIG. 4) connected to the outer end of the intermediate boom section 22. In addition, downwardly directed forces 48 are applied to the slider pads 50 and 52 (see FIG. 4) mounted on the inner end of the boom section 24. A moment is applied to the boom section by a head end 51 (FIG. 1) and is indicated schematically at 53 in FIG. 3. Of course, at any given time, the sum of the vertical and horizontal force components and the sum of the moments applied to the boom section 24 are both equal to zero when the boom section is stationary.

When the boom assembly 12 is in the operating condition subjecting the slider pads to a maximum loading, the boom section is subjected to sideward forces due to wind loading and a two percent sideward rated load component. These sideward loads are illustrated schematically in FIG. 4 with the wind load indicated by the arrows 54. The two percent rated side load component plus the wind load on the head 51 is indicated by the arrow 56. Compensating forces to offset the side loads and the moments caused by them are applied to the boom section 24 at the slider pads 44, 46, 50 and 52 in the manner illustrated schematically by the arrows 58, 59, 60 and 61, in FIG. 4. It should be noted that all of the slider pads are effective to transmit both vertical and transverse load forces. However, due to the sideward loading of the boom section 24, the transverse loads 58 and 61 transmitted by the slider pads 44 and 52 are greater than the transverse loads 59 and 60 transmitted by the slider pads 46 and 50. Of course, if the direction of the wind load indicated by the arrows 54 and the side load indicated by the arrow 56 were reversed, the slider pads 46 and 50 would be effective to transmit relatively large offsetting sideward forces.

Figure 5:
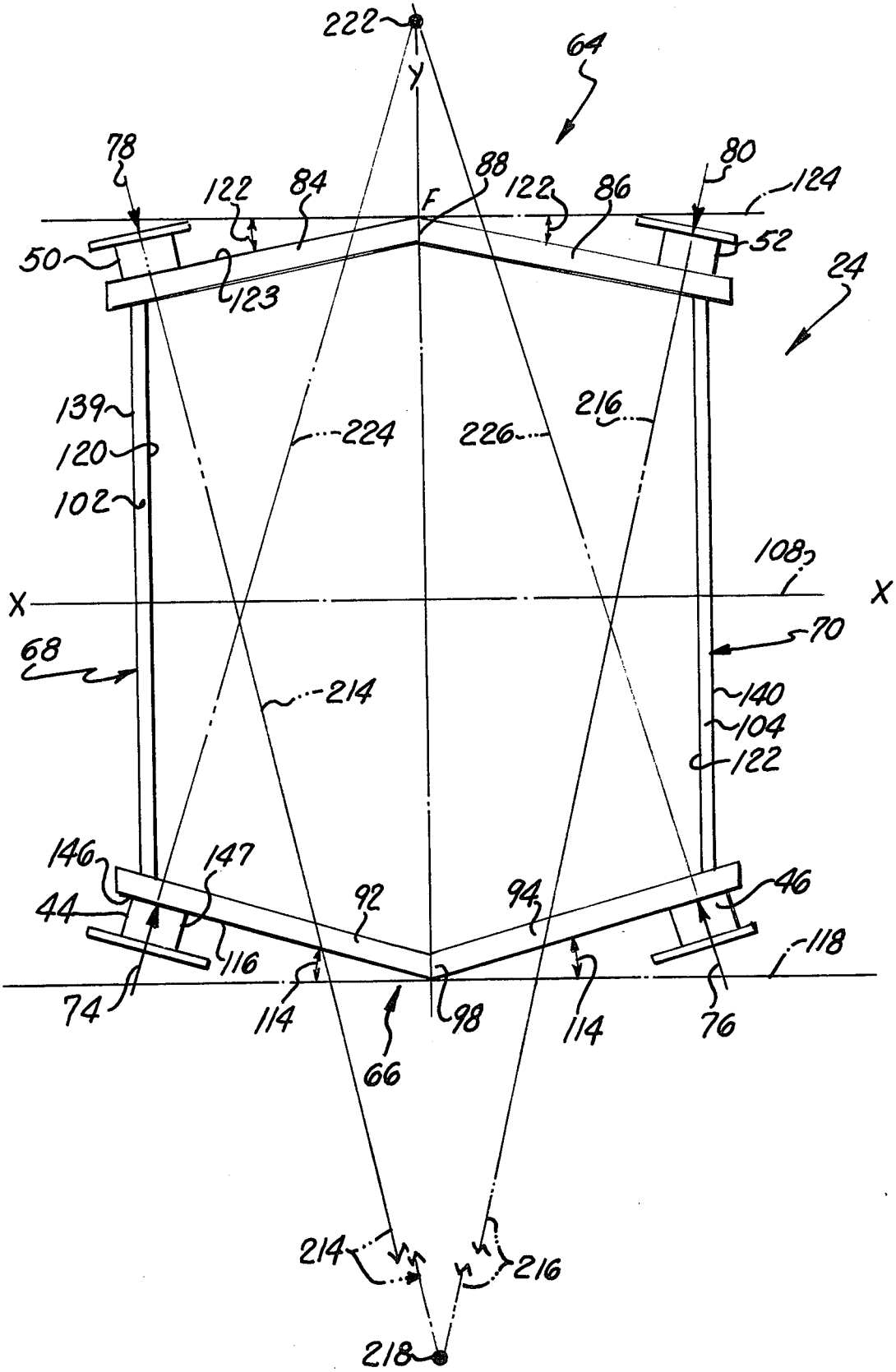
FIG. 5 is a schematic sectional view, taken generally Along the line of 5—5 of FIG. 3, illustrating the cross-sectional configuration of the boom section.

To enable both vertical and horizontal or sideward loads to be transmitted between the boom section 24 and the slider pads 44, 46, 50 and 52, the boom section 24 is provided with peaked or sloping top and bottom walls 64 and 66 (see FIG. 5). The inclined top and bottom walls 64 and 66 are interconnected by a pair of vertical side walls 68 and 70. The slider pads 44 and 46 mounted on the outer end of the boom section 22 engage the sloping bottom wall 66 of the boom section 24 and are effective to transmit forces indicated at 74 and 76 to the bottom wall 66. It should be noted that each of the forces 74 through 80 has both vertical and sideward components.

To enable both downwardly and sidewardly directed force components to be transmitted to the top wall of the enclosing boom section 22 from the slider pads 50 and 52, the top wall 64 includes a pair of sloping plate sections or flanges 84 and 86 which intersect at a peak 88 which is disposed midway between the side walls 68 and 70. The sloping flanges 84 and 86 of the top wall 64 are advantageously formed from a single plate member which is bent to form an obtuse angle at the peak 88. Similarly, the bottom wall 66 includes a pair of sloping side plate sections or flanges 92 and 94 which are interconnected at a peak 98. The bottom flanges 92 and 94 are also advantageously formed from a single plate member which is bent to form an obtuse angle at the peak 98. In the embodiment of the invention illustrated in FIG. 2, the top and bottom walls of the boom sections 20, 22 and 24 all have flanges which have the same slope relative to a horizontal plane. However, it is contemplated that the flanges of the top and bottom walls of the various boom sections 20, 22 and 24 could have different slopes. It is also contemplated that the slope of the flanges of the bottom wall of a boom section could be different than the slope of the flanges of a top wall of the boom section.

The two side walls 68 and 70 are formed from parallel plate sections 102 and 104 which are connected with the top and bottom walls 64 and 66. Although the side walls 68 and 70 have been illustrated as being formed from plates which are separate from the plates of the top and bottom walls 64 and 66, the side walls 68 and 70 could be integrally formed with either the top or bottom walls 64 and 66. It is also contemplated that the side panels 102 and 104 could be reinforced with suitable ribs or struts. If desired, the side panels 102 and 104 could be inclined relative to each other.

When the boom section 24 is fully loaded, it tends to bend abouts its central horizontal or X axis, indicated at 108 in FIG. 5. This loads the top wall 64 of the bottom section in tension and the bottom wall 66 in compression. Due to the inclined or peaked configuration of the bottom wall 66, it has a relatively large resistance to buckling under the influence of the compression loading. If the bottom wall 66 had a straight or flat configuration without the peak 98, the resistance of the bottom wall to buckling would be substantially decreased.

Although it is somewhat of an oversimplification, the bottom wall 66 of the bottom section 24 can be considered as a column which is loaded in compression. In accordance with Euler's well-known column formulas, the resistance to buckling of the column is increased by increasing the cross-sectional moment of inertia of the column. In the case of the bottom wall 66, the peaked configuration of the bottom wall provides a greater cross-sectional moment of inertia than does a flat bottom wall. Therefore, the bottom wall 66 has a greater resistance to buckling than does a flat bottom wall.

Although the peaked configuration of the top and bottom walls 64 and 66 increases their resistance to buckling, this configuration also results in relatively high stresses at the peaks 88 and 98. The stresses at any point in the boom section 24 vary as a direct function of variations in the distance of that point from the horizontal central axis indicated at 108 in FIG. 5. Therefore, the further the peaks 88 and 98 are moved from the horizontal central axis, the greater is the stress induced in the peaks upon the application of a given load to the boom section 24.

In order to minimize the stresses in the top and bottom walls 64 and 66 of the boom section 24 for a given boom load it is desirable to decrease the distance of the peaks 88 and 98 from the horizontal central axis. This can be accomplished by decreasing the inclination or slope of the panels 84, 86, 92 and 94 forming the top and bottom walls. However, if the slope of the panels forming the top and bottom walls 64 and 66 is decreased by an excessive amount, so that they have a generally flat configuration, the slider pads 44, 46, 50 and 52 will be ineffective to transmit sideward forces of a sufficient magnitude to hold the boom section 24 against sideware movement relative to the boom section 22 in which it is telescopically disposed. Decreasing the inclination of the panels 92 and 94 of the bottom wall 6 also decreases the resistance of the bottom wall to buckling under the compression forces applied to the bottom wall upon loading of the boom section 24. Therefore, the choice of an angle of inclination of the panels for the top and bottom walls in a compromise between several different conflicting factors.

In addition to the aforementioned factors of buckling strength and levels of stress induced in the boom section 24 for a given load, the angle of inclination of the panels 84, 86, 92 and 94 of the top and bottom walls 64 and 66 of the boom section 24 influences the operating life of the slider pads 44, 46, 50 and 52. This is because the forces applied to a slider pad vary across the surface of the slider pads due to twisting and side loading of the boom section.

The forces applied to the slider pads are maximized when the boom assembly 24 is fully extended at an angle of approximately 40° to a horizontal plane and is lifting a maximum vertical load with a 2 percent side load and 20 mile per hour side wind in the manner illustrated schematically in FIGS. 3 and 4. At this time, the contact forces vary between a maximum force applid to the front slider pad 44 and a minimum force applid to the slider pad 50. These maximum and minimum forces result from the moment induced by the side loading which is applied to the boom section 24 urging it toward the left as viewed in FIG. 5.

Figure 6:
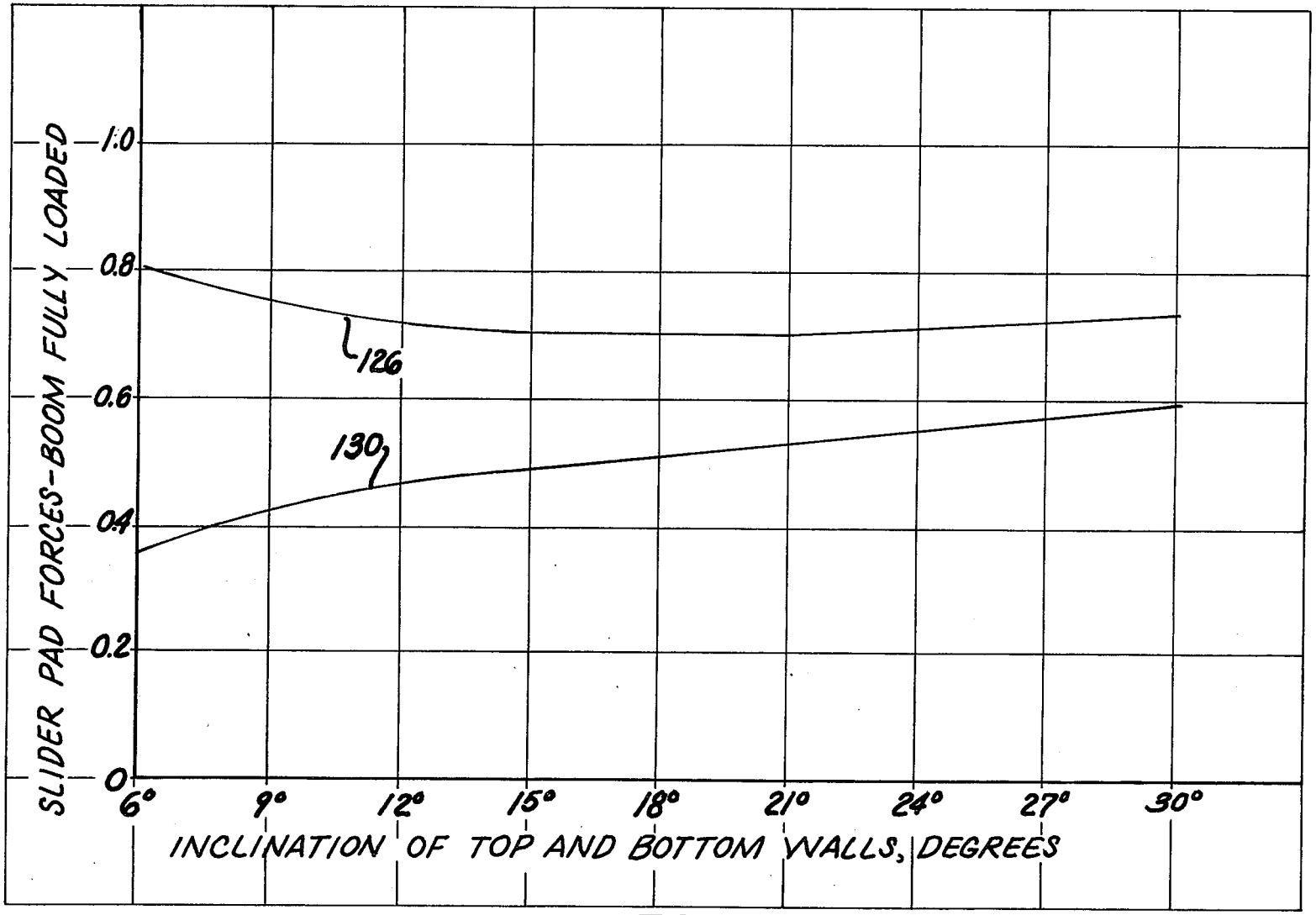
FIG. 6 is a graph depicting the variation in the maximum and minimum loads applied to a set of slider pads as a function of variations in the equal slopes of the top and bottom walls of the boom section when the boom assembly is fully extended and subjected to a maximum slider pad load.

The manner in which the minimum and maximum slider pad force loadings vary with variations in the equal angles of inclination of the top and bottom walls 64 and 66 is illustrated in FIG. 6. The angle of inclination of the bottom wall 66 is the acute angle 114 (see FIG. 5) between the major side surface 116 of the bottom wall and a horizontal plane 118 extending perpendicular to the vertical line connecting peaks 88 and 98. It should be noted that the two bottom panels or flanges 92 and 94 have the same angle of inclination or slope. Similarly, the angle of inclination of the top wall 64 is in the acute angle 122 between the major side surface 123 of the top wall and a horizontal plane 124. The two top flanges 84 and 86 have the same angle of inclination. Although the curves of FIG. 6 are for a boom construction in which the flanges have the same angle of inclination, the top and bottom flanges could have different angles of inclination.

As the angles of inclination 114 and 122 of the top and bottom walls 64 and 66 are increased from 6° to 18°, the maximum force applied to the slider pad 44 decreased to a minimum in the manner illustrated by the curve 126 of FIG. 6. As the angles of inclination of the top and bottom walls 64 and 66 are gradually increased from 18° to 30°, the maximum force applied to the slider pad 44 increases in the manner illustrated by the curve 126 in FIG. 6. It should be noted that the maximum pad force varies by a relatively small amount between approximately 11° and 27°. Therefore, from the standpoint of reducing the maximum force applied against the slider pad 44 and thereby increasing the operating life of the slider pad, the angles of inclination of the top and bottom walls 64 and 66 could vary between 11° and 27° without providing unduly large maximum slider pad forces.

The manner in which the force applied to the slider pad 50 varies with variations in the angles of inclination of the top and bottom walls 64 and 66 is indicated by the curve 130 in FIG. 6. It should be noted that although the force applied to the slider pad 50 increases as the angle of inclination increases, the force applied to the slider pad 46 does not, for the range of angles of inclination given, equal the forces applied to the slider pad 44. Therefore, in order to maximize the operating life of the slider pads 44 and 50, the angle of inclination 114 of the bottom wall 66 should be designed so as to reduce the maximum pad force. Of course, if a relatively large maximum pad force is present, moving the boom sections relative to each other will be relatively difficult and a relatively large maximum pad force will cause the slider pad to wear at a relatively high rate.

In addition to considering the slider pad loads for a fully loaded boom, the slider pad load for a boom section which is subjected only to the loads produced by the boom weights and a side wind load should be considered since this operating condition will undoubtedly be encountered. In addition, it is contemplated that this minimum load operating condition may be encountered when the boom is at a relatively large angle to the ground or other horizontal support surface. Accordingly, the boom assembly 12 has been designed to withstand wind velocities which vary with height above the ground in a manner accepted by the industry and which are based on a velocity of 20 miles per hour at a height of 20 feet when the boom is at an angle of approximately 27° to the ground and is unloaded.

When the boom is being subjected only to wind load forces and its own weight and is not being subjected to an external vertical load force, the wind load forces apply a large part of the moment on any boom section. This results in a major portion of the slider pad loading being applied to one of the bottom slider pads and to the opposite top slider pad. Specifically, a relatively large load is applied to the bottom slider pad on the downwind side of the boom assembly, that is the slider pad 44 of FIG. 4, and to the upper slider pad on the upwind side of the boom assembly, that is the slider pad 52 in FIG. 4. When the boom section 24 is externally loaded only by the wind forces indicated by the arrows 54 in FIG. 4, the boom section 24 will tend to rotate away from the slider pads 46 and 50. The loads on the slider pads 46 and 50 will, to a large extent at least, be the result of only the deadweight indicated by the arrows 36 in FIG. 3.

Figure 7:
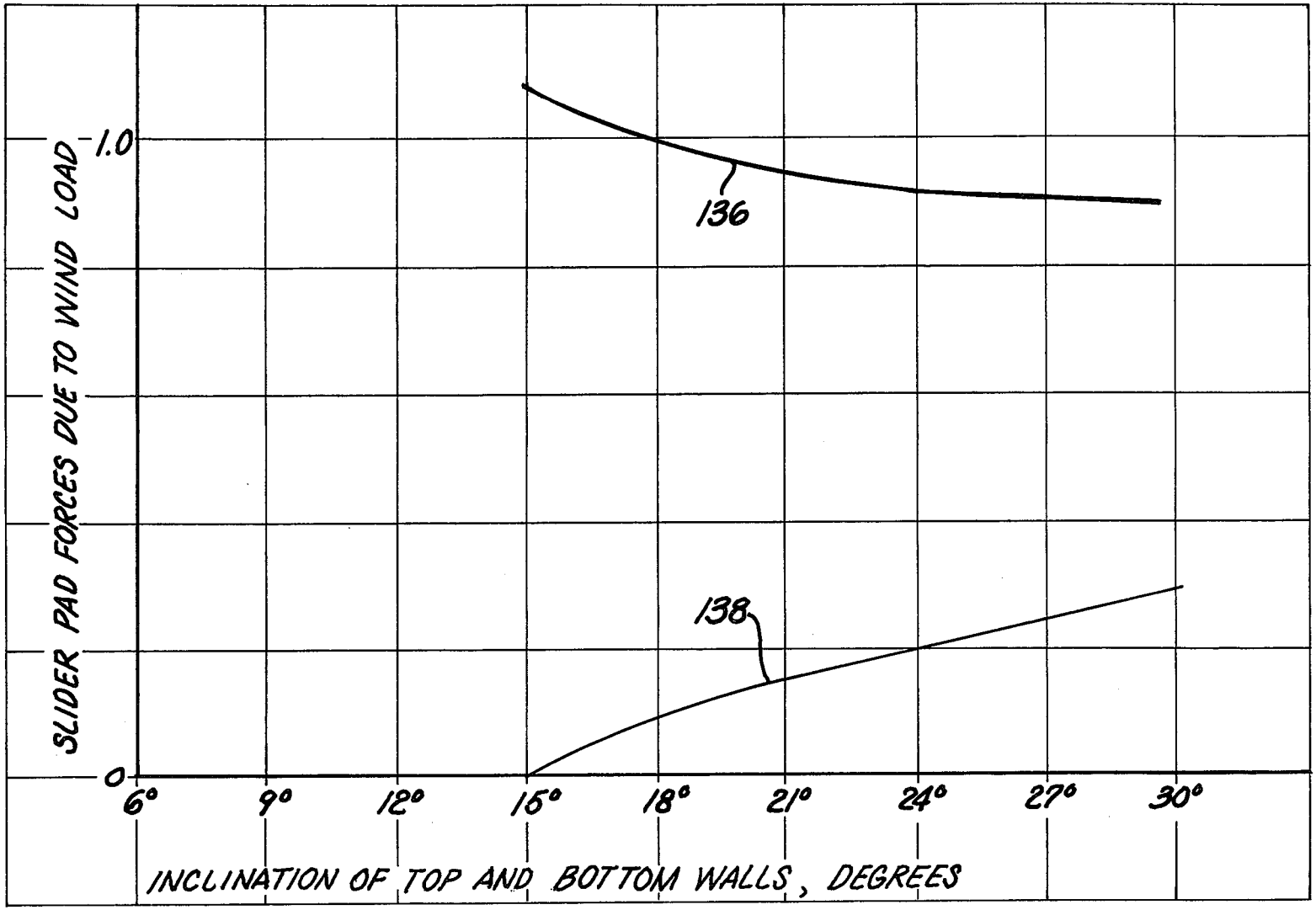
FIG. 7 is a graph illustrating the variation in maximum and minimum loads applied to a set of slider pads as a function of variations in the equal slopes of the top and bottom walls of the boom section when the boom assembly is fully extended at a maximum operating angle to the ground and is subjected to only wind loadings and the weight of the boom sections.

The force applied to the slider pad 44 by the boom section 24 under the influence of only wind forces and the weight of the boom itself will vary with variations in the angles of inclination 114 and 122 of the top and bottom walls 64 and 66 in the manner illustrated by the curve 136 in FIG. 7. The force on the slider pad 50 will vary with variations in the equal angles of inclination of the top and bottom walls 64 and 66 in the manner illustrated by the curve 138. It should be noted that the curves 136 and 138 are for a boom section having top and bottom walls with equal angles of inclination. The slider pad forces represented by the curves 136 and 138 occur on comparable pads on boom section 22 when the boom sections 22 and 24 are fully extended at an angle of 78° to a horizontal plane and are subjected to only the external wind load and the weight of the boom.

When the bottom wall 66 and the top wall 64 have equal angles of inclination which are less than 15° the wind load is sufficient to rotate the boom section 22 so that the slider pad comparable to 50 is unloaded. However, when the equal angles of inclination of the bottom wall 66 and the top wall 64 are greater than 15°, a portion of the load is carried by the slider pad comparable to 50.

Figure 8:
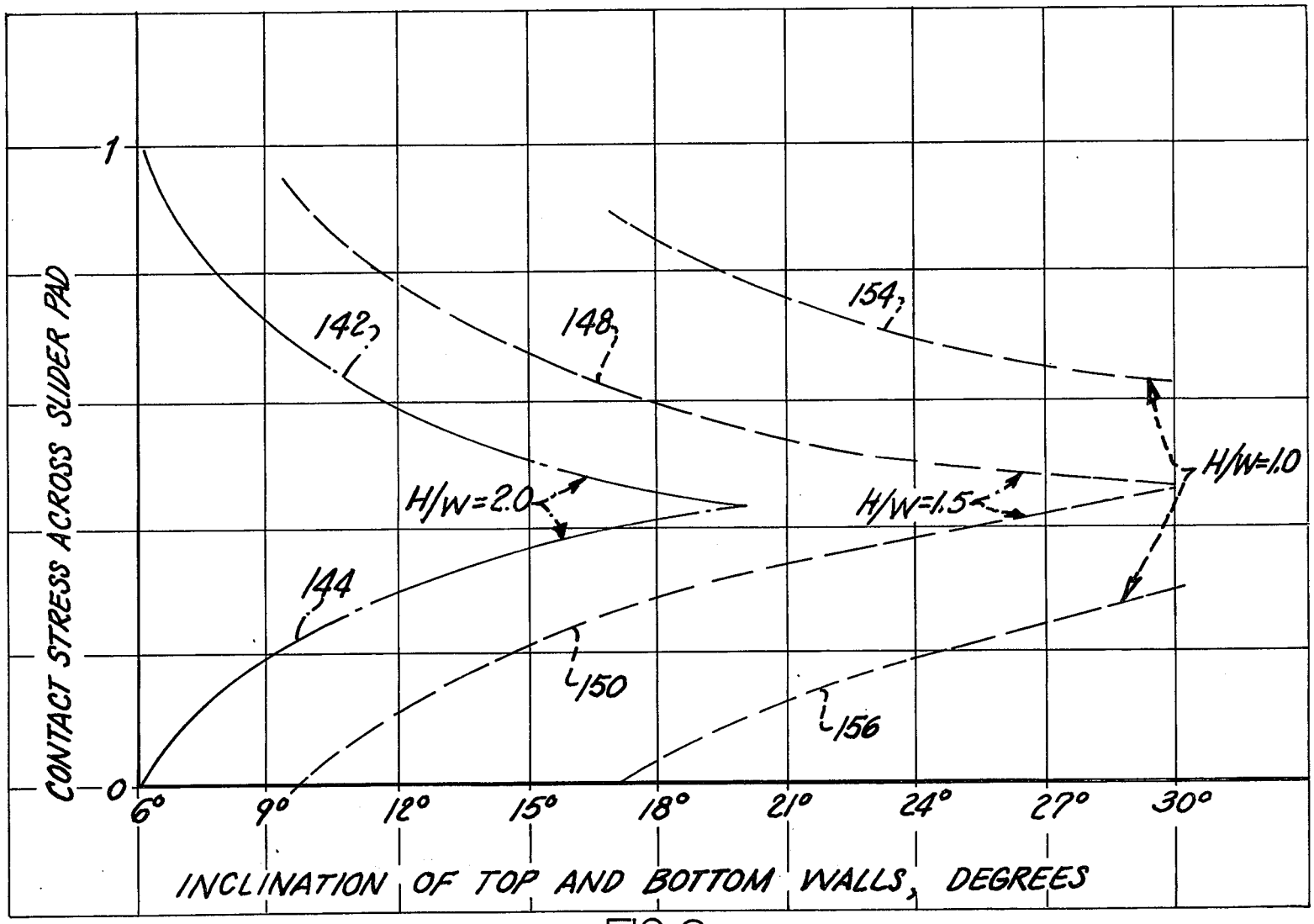
FIG. 8 is a graph depicting variations in the maximum and minimum slider pad contact stresses in the most heavily loaded slider pad and how these contact stresses vary with variations in the height-to-width ratio of the boom section and the equal slopes of the top and bottom walls of the boom section.

The variations in contact stresses across the most heavily loaded slider pad on boom 22 comparable to pad 44 on boom 24 with variations in the equal angles of inclination namely 114 of the boom wall 66 and 122 of top wall 64, is illustrated graphically in FIG. 8 for the boom 22 in a condition that maximizes slider pad load, that is the boom is fully extended at an angle of 40° to the ground and is lifting a maximum load with a 2 percent side load and a wind load of 20 miles per hour. The stresses in the most heavily loaded slider pad comparable to pad 44 vary as a function of both the angle of inclination of the top and bottom walls 66 and 64 and the height-to-width ratio ($h/w$) of the boom section. The overall height ($h$) of the boom section 24 is the distance from the outside of the top peak 88 to the outside of the bottom peak 98. The overall width ($w$) is the distance between the outer surfaces 139 and 140 of the side walls 68 and 70.

The maximum forces applied to the slider pads do not vary significantly with variations in the height-to-width ratio of the boom. However, the maximum slider pad stresses do vary significantly with variations in the height-to-width ratio of the boom and with variations in the equal angles of inclination of the top and bottom walls 64 and 66. This is because there is a tendency for the boom section to twist or flex about its central axis with a resulting uneven loading of the slider pads which varies as a function of variations in the height-to-width ratio.

For a height-to-width ratio of 2, that is the total overall height of the boom section is twice as great as the total overall width, the maximum stress at any point in the most heavily loaded pad, namely the one on boom 22 comparable to pad 44 on boom 24, will vary with variations in top and bottom wall inclination in the manner illustrated by the curve 142 in FIG. 8. The minimum stress in the same pad will vary with variations in the top and bottom wall inclination in the manner illustrated by the curve 144 in FIG. 8. It should be noted that the maximum stress occurs in the portion of the slider pad 44 adjacent to the corner 146 (see FIG. 5). Similarly, the minimum stress occurs in the portion of the slider pad 44 adjacent to the corner 147.

For a height-to-width ratio of 1.5, the maximum stress in the most heavily loaded pad varies with variations in the top and bottom wall inclinations in the manner illustrated by the curve 148 in FIG. 8 and the minimum stress varies in the manner illustrated by the curve 150. For a height-to-width ratio of 1, that is a boom having a total height from peak to peak which is equal to the distance between the side walls, the maximum stress in the most heavily loaded slider pad will vary with variations in the top and bottom wall inclination angles in the manner illustrated by the curve 154 and the minimum stresses will vary in the manner illustrated by the curve 156.

When the minimum stress at a point in the slider pad is zero, the boom section has twisted to such an extent that only a portion of the slider pad is loaded by the boom section and the boom will have moved away from the remainder of the pad. This occurs at a bottom wall inclination angle of approximately nine degrees for a slider pad having height-to-width ratio of 1.5. Of course, such a stress distribution is detrimental to slider pads and is to be avoided.

The elastic stability of the side walls 68 and 70 of the boom section 24 is increased by the inclined or sloping top and bottom walls 64 and 66 of the boom section. This is because the elastic stability of the side walls is inversely proportional to the square of the height-to-thickness ratio of the side panels 102 and 104. Thus, for a given side wall panel thickness, the elastic stability of the side wall varies as a function of a square of the height of the side wall panels. By inclining the top and bottom walls 64 and 66 at the angles 114 and 122, the height of the side wall panels 102 and 104 is decreased with a resulting increase in the elastic stability of the boom section.

In order to provide maximum buckling strength with minimum peak stresses and, at the same time, to maximize the lateral stability and strength of the boom section 24, the top and bottom panels 84, 86, 92 and 94 are inclined or sloped at angles of from 12° to 19° relative to the associated horizontal planes. A height-to-width ratio which is greater than 1 and less than 3 is preferred to obtain the desired stability with minimum slider pad stresses while providing an interior space within the boom section for a motor and cables to extend and retract the boom assembly.

Figure 9:
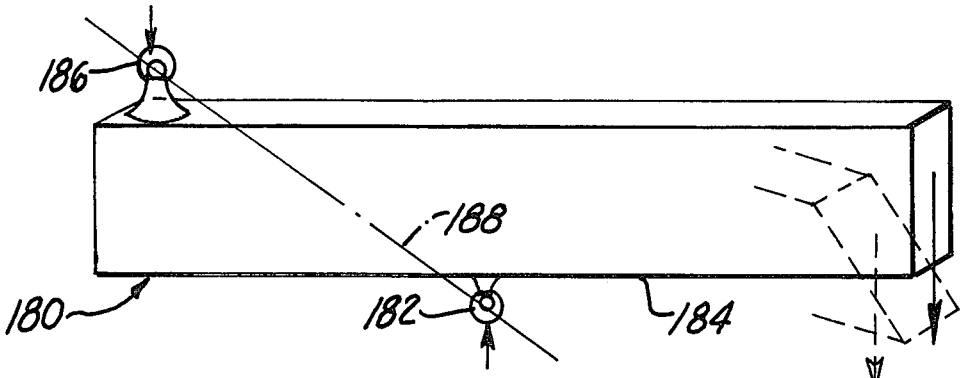
FIG. 9 is a schematic illustration of a laterally unstable boom support system.

In addition to elastic side wall stability, the boom section must have lateral stability. A laterally unstable boom 180 having a rectangular cross-sectional configuration is illustrated schematically in FIG. 9. The boom 180 is supported by a ball and socket 182 which is connected to a bottom wall 184 of the boom. A second ball and socket 186 applies a downwardly directed force against the end of the boom 180. With this type of support and load application, there is a strong tendency for the boom to deflect sidewardly, in the manner illustrated schematically in dashed lines in FIG. 9, upon applicaion of a vertical load to the end of the boom. It should be noted that a plane, indicated by the line 188 in FIG. 9, through the points of support of the boom 180, extends below the point of application of the load to the boom. Therefore, the slightest sideward load or moment on the boom will cause or tend to cause it to rotate about this line. Once this rotational tendency is initiated, the vertical load will accentuate the tendency.

Figure 10:
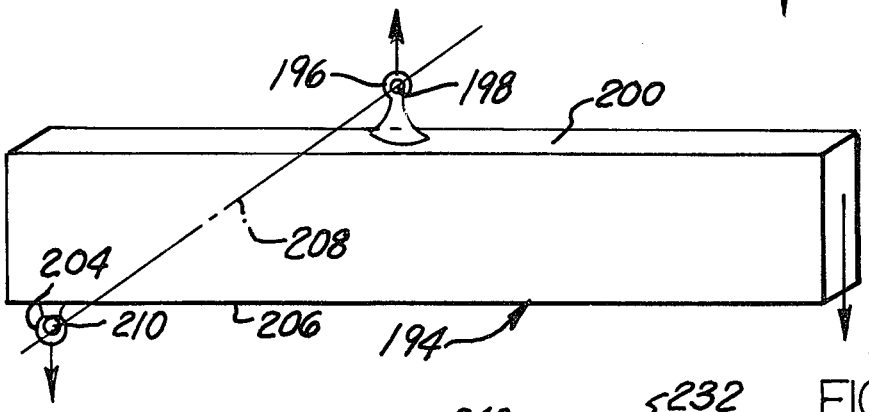
FIG. 10 is a schematic illustration of a laterally stable boom support system.

A laterally stable boom 194 is illustrated schematically in FIG. 10. The boom 194 is supported by a ball and socket 196 which is illustrated schematically as being connected with the top or upper surface 200 of the boom 194. Similarly, a second ball and socket 204 is utilized to apply a downwardly directed force closely adjacent to the bottom surface 206 of the boom. A plane, through the pivot connection 210 of the ball and socket 204 and through the pivot connection 198 of the ball and socket 196, is indicated at 208 in FIG. 10. The plane 208 extends above the point of application of the vertical load to the outer end of the boom. Since the plane of support 208 extends above the point of application of the vertical load to the outer end of the boom, the vertical load merely tends to pull the outer end of the boom section straight downwardly without twisting the boom. Even if a sideward force or moment tending to deflect the boom sidewardly is applied to the boom 194, the laterally stable support arrangement for the boom 194 prevents lateral or sideward deflection of the boom under the influence of a vertical load. Thus, a laterally stable boom support arrangement is obtained when the downwardly directed forces at the inner end of the boom are effectively applied to the boom at a location which is below the point at which the upwardly direct support forces are effectively applied to the boom. This results in a rising plane of support 208 rather than a falling or declining plane of support, similar to the plane of support 188 of FIG. 9.

The angles of inclination of the top and bottom walls of the boom section 24 have been related to the height-to-width ratio of the boom section 24 so as to enable the slider pads 44, 46, 50 and 52 to apply forces to the boom section 24 in such a manner that the boom section is laterally stable. This is obtained by having the lines of action 214 and 216 (FIG. 5) of the upper slider pad forces 78 and 80 intersect at a point 218, which is below the point of intersection 222 for the lines of action 224 and 226 for the lower slider pad forces 74 and 76. A plane of support through the point of intersection 218 of the upper slider pad forces 78 and 80 and the point of intersection 222 of the lower slider pad forces 74 and 76 is a rising plane which extends well above the point of application of the load to the outer end of the boom section 24 in the manner illustrated schematically for the boom 194 in FIG. 10. Therefore, the boom section 24 is laterally stable.

If the flange angles 114 and 122 were increased to an amount such that the point of intersection 218 of the upper slider pad forces 78 and 80 was above the points of intersection of the lower slider pad forces 74 and 76, the boom section 24 would be laterally unstable. For a given flange angle, the distance between the points of intersection 218 and 222 of the lines of action of the slider pads can be varied by merely moving the slider pads toward or away from the vertical central axis of the boom section. Of course, the points of intersection 218 and 222 can be closer than is illustrated schematically in FIG. 5. In fact, it is contemplated that the points of intersection 218 and 222 will be disposed between the top and bottom walls 64 and 66.

If the boom section is built with top and bottom walls 64, and 66 having equal angles of inclination, that is, the angles 114 and 122 are equal, the point of marginal lateral stability of the boom section is reached when the lines of action for the slider pad forces all intersect at the center of the boom section. Thus, for equal angles of inclination for the top and bottom walls 64 and 66, the lines of action 214 and 216 for the slider pad forces 78 and 80 should intersect at a point below a plane containing the central longitudinal axis 108 of the boom section 24 and extending perpendicular to a vertical plane. Similarly, the point of intersection of the lines of action 224 and 226 for the bottom slider pad forces 74 and 76 should, for equal top and bottom wall angles of inclination, intersect at a point above the plane which contains the longitudinal central axis of the boom section 24 and extends perpendicular to a vertical plane.

If the top and bottom walls 64 and 66 had different angles of inclination, it would be possible to have a laterally stable boom section with both of the points of intersection of the lines of action of the slider pad forces either above or below the center of the boom section. Thus, if the bottom wall 66 had relatively large angle of inclination, while the top wall 64 had a relatively small angle of inclination, the point of intersection of the bottom slider pad forces 74 and 76 could be below the center of the boom section while the point of intersection of the upper slider pad forces 78 and 80 would be still further below the center of the boom section. Since the boom section would have a rising plane of support, it would be laterally stable.

Figure 11:
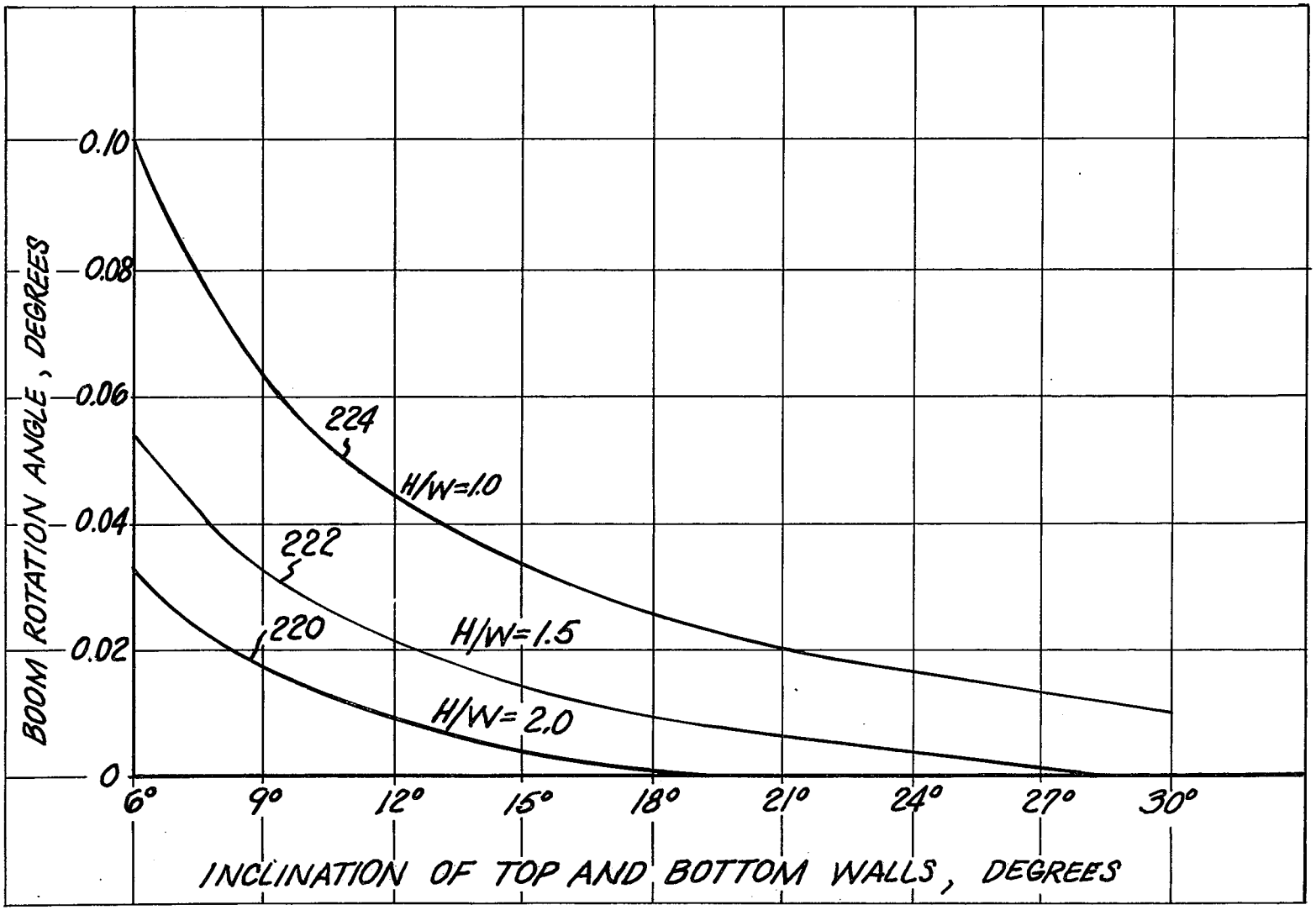
FIG. 11 is a graph depicting variations in the extent of the rotation of one boom section relative to the enclosing boom section with variations in the ratio of the height-to-width of the boom sections and with variations in the equal slopes of the top and bottom walls of the boom sections.

The angular extent to which a boom section is twisted about its central axis in a fully loaded condition varies as a function of both the height-to-width ratio of the boom section and the angle of inclination of the top and bottom side walls in the manner illustrated graphically in FIG. 11. Thus, the curve designated 220 illustrates the extent to which the boom section is twisted for a height-to-width ratio of 2 with variations in the angles of inclination of the top and bottom walls, that with variations in the angles 114 and 122 of FIG. 5. Similarly, when the height-to-width ratio is changed to either 1.5 or 1, the extent to which the boom section is twisted relative to the adjacent boom section when the boom assembly is fully loaded is depicted by the curves 222 and 224.

The boom section 24 is considered as being stable for a given height-to-width ratio and top and bottom wall angle of inclination when there is twisting of the boom section without lateral shifting of the boom section. Thus, a boom section having a height-to-width ratio of 2 is stable when the top and bottom wall angles of inclination, that is the angles 114 and 122 of FIG. 5, are less than 19.8°. If the angles 114 and 122 are greater than 19.8°, the boom section shifts laterally rather than twisting. Similarly, the stability limit for a height-to-width ratio of 1.5 is less than approximately 30°. The stability limit for a height-to-width ratio of 1 is less than approximately 56.7°. The stability limits for the various height-to-width ratios are based on a condition where a rotation of one boom inside another will neither raise or lower the gravity loads. The angles of inclination of the top and bottom side walls should be less than the stability limits.

It is contemplated that after an extended period of use the slider pads will wear and it will be necessary to replace them. The slider pads on the axially outer ends of the boom sections, for example, the slider pads 44 and 46, are quite accessible and easy to replace. However, the slider pads on the axially inner ends of the boom sections, that is, the slider pads 50, 52 are rather inaccessible since they are disposed within another boom section.

Figure 12:
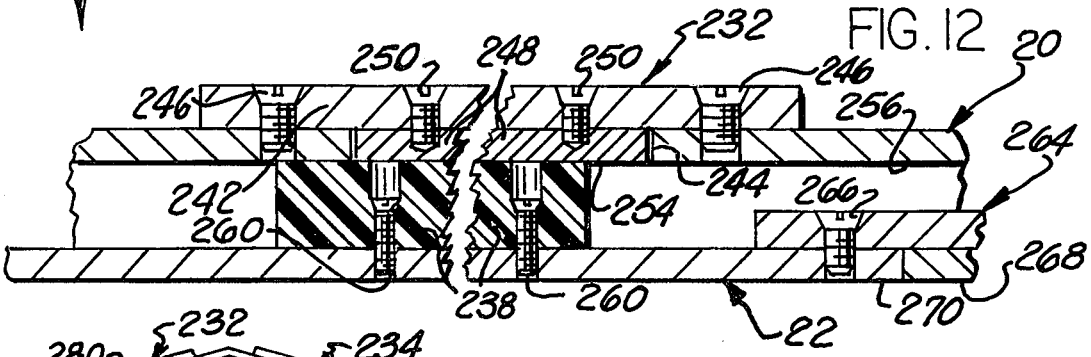
FIG. 12 is an enlarged fragmentary sectional view of a slider pad access opening formed in the top wall of a boom section.

To provide access to the axially inner slider pads, a plurality of covered openings have been formed in the various boom sections. Thus, the base boom section 20 is provided with a pair of covers 232 and 234 which provide access to the slider pads on the boom section 22 (see FIG. 2). The relationship between the cover 232 and a slider pad 238 on the boom section 22 is illustrated in FIG. 12. The cover 232 includes a base or outer plate 242 which extends across a rectangular opening 244 formed in the outer wall of the boom section 20. The base plate 242 is releasably connected with the boom section 20 by a plurality of fasteners 246. A filler plate 248 is substantially the same size as the opening 244 and is mounted on the base plate 242 by fasteners 250. The filler plate 248 has a major side surface 254 which is disposed in alignment with an inner surface 256 of the boom section 20. Due to the alignment of the cover surface 254 with the inner surface 256 of the boom section 20, the slider pad 238 on the boom section 22 can slide easily across the opening 244 when the cover 232 is in place.

When the slider pad 238 is to be replaced, it is merely necessary to loosen the fasteners 246 and remove the cover 232. This provides access through the opening 244 to fasteners 260 which connect the slider pad 238 to the boom section 22. Upon releasing of the fasteners 260, the slider pad 238 can be readily replaced. If necessary, the load on the slider pad 238 can be relieved by merely pressing the boom section 22 downwardly against the ground or a suitable abutment. Once the slider pad 238 has been replaced, the cover 232 is reconnected to the boom section 20.

After replacement of the slider pad 238, it may be desired to replace the slider pad 50 on the boom section 24 (see FIG. 4). This is undertaken by moving the boom section 22 telescopically inwardly so that a cover 264 (FIG. 12) is in alignment with the opening 244. The fasteners 266 are then removed to release the cover 264 from the boom section 22. Once the cover 264 has been removed, the slider pad 50 is readily accessible and can be easily replaced. It should be noted that the cover 264 has an inner surface 268 which is aligned with an inner surface 270 of the boom section to facilitate movement of the slider pad 50 along the inner surface of the boom section. Although only the covers 232 and 264 have been illustrated in FIG. 12 to provide access to the slider pads on one side of the boom assembly 12, covers, similar to the covers 234 of FIG. 2, are provided in the boom section 20 and 22 to provide access to the slider pads on the other side of the boom assembly.

Figure 13:
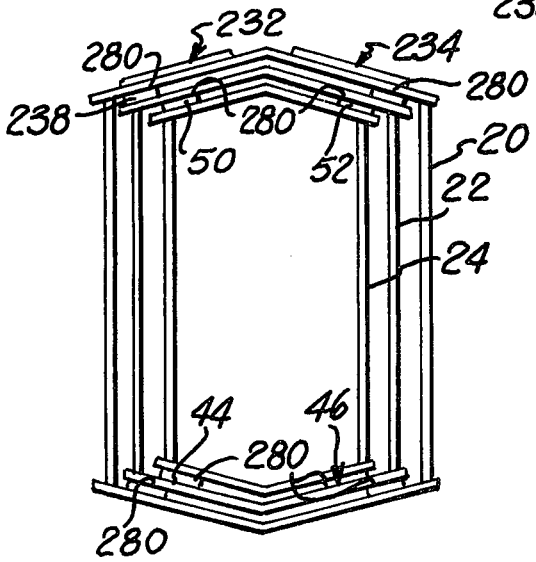
FIG. 13 is a fragmentary schematic sectional view similar to FIG. 5, illustrating the relationship between slider pads and strips of hard metal on the walls of the boom sections.

During telescopic movement of one boom section relative to the other, the slider pads on one boom section slide along surfaces on another boom section. To prevent wear of the surfaces of the boom sections and to reduce friction forces which oppose relative boom motion, hard metal strips may advantageously be provided along the top and bottom walls of the boom sections. Since the slider pads on the axially inner ends of the boom sections move along the inner surfaces of the top wall of the associated boom sections, hard metal strips 280 are connected to the inner surfaces of the top walls of the boom sections in the manner illustrated in FIG. 13. Similarly, the axially outer slider pads are associated with the outer surfaces of the bottom walls of the various boom sections so that hard metallic strips 280 are mounted on the outer surfaces of the bottom walls of the boom sections.

Figure 14:
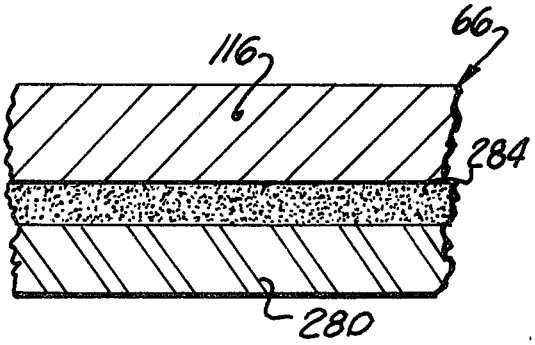
FIG. 14 is an enlarged fragmentary cross-sectional view illustrating the manner in which a strip is mounted on the wall of a boom section of FIG. 13.

The manner in which the hard metal strip 280 is mounted on the flange 116 of the bottom wall 66 of the boom section 24 is illustrated in FIG. 14. The hard metal strip is connected with the flange section 116 of the bottom wall 66 by a layer 284 of adhesive. The metal strip 280 is preferably formed of a corrosion resistant stainless steel and may advantageously be obtained in the form of a tape on which the layer 284 of adhesive is disposed. By utilizing a stainless steel tape to form the hard metal strip 280, fabrication of the boom assembly is facilitated. It should be noted that fabrication of the boom assembly is also facilitated by forming the various boom sections from metal plates having a hardness and corrosion resistance which is significantly less than the hardness of the strips 280. Of course, if the wear of the top and bottom walls of the various boom sections under the influence of the slider pads and the friction is not objectionable, the hard metal strips 280 could be omitted.

In view of the foregoing description, it can be seen that the boom section 24 has a cross-sectional configuration which, for the weight and size of the material utilized to construct the boom section, tends to maximize the strength, stiffness and lateral stability of the boom section. The improved strength, stiffness and lateral stability of the boom section results from the peaked or sloping configuration of the top and bottom walls 64 and 66 of the boom section. By providing the top and bottom walls 64 and 66 with a peaked or sloping configuration, the slider pad forces provide both vertical and horizontal reaction forces for the boom section. The use of the peaked or sloping configuration for the top and bottom walls 64 and 66 provides the necessary geometry to keep the boom section 24 centered within the enclosing boom section 22 when the boom section 24 is subjected to side forces due to either laterally applied loads or wind forces. Although the top and bottom walls 64 and 66 have been described herein as being formed from longitudinally extending pieces which have been bent to form the peaks, it is contemplated that the top and bottom walls will be fabricated from pieces which are welded together at the peaks. The peaked or sloping configuration of the bottom wall 66 of the boom section 24 also increases the buckling strength of the bottom wall under the influence of compression forces.

The slope of the peaked top and bottom walls 64 and 66 relative to a horizontal plane is advantageously made between 12° and 19°, thus the angles 114 and 122 can vary between 12° and 19°. Although it may be preferred to have equal top and bottom angles 114 and 122, it is contemplated that the boom section could be made with top and bottom angles 114 and 122 of different sizes. By forming the top and bottom walls 64 and 66 of the boom section 24 with angles of inclination 114 and 122 of between 12° and 19°, the top and bottom peaks 88 and 98 are relatively close to the horizontal central axis 108 of the boom section 24. This prevents the formation of excessive stresses at the peaks 88 and 98 upon the application of a load to the boom tending to bend the boom about the axis 108.

The peaked or sloping configurations of the top and bottom walls 64 and 66 of the boom section 24 results in the slider pad forces having intersecting lines of action. To provide the boom section 24 with lateral stability, the lines of action 214 and 216 to the slider pad forces 78 and 80 against the top wall 64 of the boom section 24 intersect at a point which is below the intersection of the lines of action 224 and 226 of the slider pad forces 74 and 76a against the bottom walls of the boom section 24.

Since the elastic stability of the side walls 68 and 70 of the boom section 24 is inversely proportional to the square of the height-to-thickness ratio of the side walls of the boom section 24, the peaked configuration of the top and bottom walls 64 and 66 of the boom section increases the elastic stability of the side walls. This is because the height of the side walls 68 and 70, for a given overall height and width of the boom section 24, is decreased by the peaked configuration of the top and bottom walls 64 and 66 of the boom section.

The torsional stiffness of the boom section 24 is directly proportional to the square of the area enclosed by a median or center line through the top, bottom and side walls 64, 66, 68 and 70 of the boom section 24 and is inversely proportional to the integral of the differential perimeter divided by the wall thickness. When this stiffness constant is evaluated for the boom section 24, the decrease in the height of the side walls 68 and 70 due to the peaked configuration of the boom section 24 causes a ratio of the torsional stiffness to the corss-sectional area to increase as the angles of inclinations 114 and 122 of the top and bottom walls are increased through the range of angles being considered. The increased torsional stiffness of the boom section 24 contributes to an increase in the lateral elastic stability of the boom.

It is contemplated that it would be necessary to replace one or more of the slider pads after the boom assembly 12 has been utilized for a substantial period of time. Replacement of the slider pads on the axially inner end portions of the boom sections 22 and 24 is facilitated by providing access openings, similar to the access openings 232, 234 and 264 in the top walls of the boom sections. During operation of the boom assembly, the access openings are closed by covers having inner surfaces which are aligned with the inner surfaces of the associated boom sections and are engaged by the slider pads as the boom assembly is extended and retracted.

In order to minimize wear of the walls of the boom sections by the slider pads and to reduct friction forces, strips 280 of stainless steel are mounted on the boom section walls along the paths of movement of the slider pads. These hard metal strips are advantageously mounted on the boom section walls with layers 284 of a suitable adhesive.

Although only the boom section 24 has been extensively described herein, it should be understood that the boom sections 20 and 22 have the same cross-sectional configuration as the boom section 24. Therefore, the boom sections 20 and 22 will also have improved strength, stiffness and lateral stability. If desired, the angles of inclination of the top and bottom walls of the various boom sections could be different. Thus, it is contemplated that the angle of inclination of the top wall of the boom section 24 could be different than the inclination of the top wall of the boom section 22. It is also contemplated that certain features, such as the releasable covers to provide access to the axially inner slider pads or the hard metal strips, could be used alone in association with boom sections having a construction other than the illustrated construction. It is also contemplated that a boom section having the illustrated construction could be utilized without these advantageous features.

Having described one specific preferred embodiment of the invention, the following is claimed:

1. A boom assembly comprising a plurality of longitudinally extending boom sections disposed in a telescopic relationship with each other, first slider means connected with an outer end portion of a first one of said boom sections and disposed in engagement with a second one of said boom sections for at least partially supporting said second boom section for axial movement relative to said first boom section, second slider means connected with an inner end portion of said second boom section and disposed in engagement with said first boom section for further supporting said second boom section for axial movement relative to said first boom section, said second boom section including longitudinally extending top and bottom walls interconnected by a pair of longitudinally extending side walls, said top, bottom and side walls having longitudinal central axes extending parallel to the central axis of said second boom section, said top wall including a pair of interconnected longitudinally extending top plate sections which extend upwardly from said side walls and intersect at a top peak between said side walls, said top plate sections having major side surfaces which extend at acute angles to a plane extending perpendicular to one of said side walls and which intersect at an obtuse angle at said top peak, said bottom wall including a pair of interconnected longitudinally extending bottom plate sections which extend downwardly from said side walls and intersect at a bottom peak between said side walls, said bottom plate sections having major side surfaces which extend at acute angles to a plane extending perpendicular to one of said side walls and which intersect at an obtuse angle at said bottom peak, said first slider means includes means for applying a first force to a first one of said bottom plate sections and means for applying a second force to a second one of said bottom plate sections, said first and second forces having lines of action which intersect at a point above a plane which contains the central longitudinal axis of said second boom section and which extends perpendicular to a vertical plane, said second slider means including means for applying a third force to a first one of said top plate sections and means for applying a fourth force to a second one of said top plate sections, said third and fourth forces having lines of action which intersect at a point below the plane which contains the central longitudinal axis of said second boom section.

2. A boom assembly as set forth in claim 1 wherein said first boom section includes longitudinally extending inner surface means for engaging said second slider means during axial movement between said first and second boom sections, means defining an opening in said first boom section extending through said longitudinally extending inner surface means of said first boom section and at least partially disposed in a path of movement of said second slider means along said longitudinally extending inner surface of said first boom section, and releasable cover means movable between a closed position blocking said opening in said first boom section and an open position in which said second slider means is accessible from outside of said first boom section through said opening, said releasable cover means including surface means which forms a continuation of said longitudinally extending inner surface of said first boom section when said cover means is in said closed position.

3. A boom assembly as set forth in claim 1 wherein said first boom section includes a longitudinally extending top wall formed of a first material, a longitudinally extending strip of a second material which is harder than said first material and which is secured to said top wall of said first boom section, said second slider means including surface means movable along said strip of a second material upon axial movement between said first and second boom sections.

4. A boom assembly as set forth in claim 1 wherein bottom plate sections of said second boom section are formed of a first material, said second boom section including a longitudinally extending strip of a second material which is harder than said first material and is secured to one of said bottom plate sections, said first slider means including surface means movable along said strip of a second material upon axial movement between said first and second boom sections.

5. A boom assembly as set forth in claim 1 wherein said major side surfaces of said top and bottom plate sections all extend at the same angle to the plane which extends perpendicular to one of said sidewalls.

6. A boom assembly as set forth in claim 1 wherein said major side surfaces of said top plate sections extend at a first angle to the plane which extends perpendicular to one of said sidewalls, said major side surface of said bottom plate sections extending at a second angle to the plane which extends perpendicular to one of said sidewalls, said first and second angles being of different magnitudes.

7. A boom assembly as set forth in claim 1 wherein said sidewalls have major side surfaces which extend parallel to each other and said acute angles are between 12° and 19°.

8. A boom assembly as set forth in claim 7 wherein said second boom section has an overall height ($h$) equal to the distance between said top and bottom peaks and an overall width ($w$) equal to the distance between outer side surfaces of said side walls, said second boom section having a height-to-width ratio ($h/w$) which is greater than 1 and less than 3.

9. A boom assembly comprising a plurality of longitudinally extending boom sections disposed in a telescopic relationship with each other, first and second slider means connected with an outer end portion of a first one of said boom sections and disposed in engagement with a second one of said boom sections for at least partially supporting said second boom section for axial movement relative to said first boom section, third and fourth slider means connected with an inner end portion of said second boom section and disposed in engagement with said first boom section for further supporting said second boom section for axial movement relative to said first boom section, said second boom section including longitudinally extending top and bottom walls interconnected by a pair of longitudinally extending side walls, said top, bottom and side walls having longitudinal central axes extending parallel to the central axis of said second boom section, said top wall including a pair of interconnected longitudinally extending top plate sections which extend upwardly from said side walls and intersect at a top peak between said side walls, said top plate sections having major side surfaces which extend at acute angles to a plane extending perpendicular to one of said side walls and which intersect at an obtuse angle at said top peak, said bottom wall including a pair of interconnected longitudinally extending bottom plate sections which extend downwardly from said side walls and intersect at a bottom peak between said side walls, said bottom plate sections having major side surfaces which extend at acute angles to a plane extending perpendicular to one of said side walls and which intersect at an obtuse angle at said bottom peak, said first slider means including means for applying a first force to a first one of said bottom plate sections, said second slider means including means for applying a second force to a second one of said bottom plate sections, said first and second forces having lines of action which intersect at a point above a first plane which extends through the top peak of said second boom section and extends perpendicular to a vertical plane, said third slider means including means for applying a third force to a first one of said top plate sections, said fourth slider means including means for applying a fourth force to a second one of said top plate sections, said third and fourth forces having lines of action which intersect at a point below a second plane which extends through the bottom peak of said second boom section and extends parallel to said first plane.

10. A boom assembly comprising a plurality of longitudinally extending boom sections disposed in a telescopic relationship with each other, first and second slider means connected with an outer end portion of a first one of said boom sections and disposed in engagement with a second one of said boom sections for at least partially supporting said second boom section for axial movement relative to said first boom section, third and fourth slider means connected with an inner end portion of said second boom section and disposed in engagement with said first boom section for further supporting said second boom section for axial movement relative to said first boom section, said second boom section including longitudinally extending top and bottom walls interconnected by a pair of longitudinally extending side walls, said top wall including a pair of interconnected longitudinally extending top plate sections which extend upwardly from said side walls and intersect at a top peak which is disposed substantially midway between said side walls, said top plate sections having major side surfaces which extend at substantially equal acute angles to a plane containing the central longitudinal axis of said second boom section and extending perpendicular to a vertical plane, said bottom wall including a pair of interconnected longitudinally extending bottom plate sections which extend downwardly from said side walls and intersect at a bottom peak which is disposed substantially midway between said side walls, said bottom plate sections having major side surfaces which extend at substantially equal acute angles to the plane containing the central longitudinal axis of said second boom section and extending perpendicular to a vertical plane, said first slider means including means for applying a first force to a first one of said bottom plate sections at a location offset to one side of said bottom peak, said second slider means including means for applying a second force to a second one of said bottom plate sections at a location offset to another side of said bottom peak, said first and second forces having lines of action intersecting at a point above said plane which contains the longitudinal axis of said second boom section and which extends perpendicular to a vertical plane, said third slider means including means for applying a third force to a first one of said top plate sections at a location offset to one side of said top peak, said fourth slider means including means for applying a fourth force to a second one of said top plate sections at a location offset to another side of said top peak, said third and fourth forces having lines of action intersecting at a point below said plane which contains the central longitudinal axis of said second boom section and which extends perpendicular to a vertical plane.

11. A boom assembly comprising a plurality of boom sections disposed in a telescopic relationship with each other, each of said boom sections having top and bottom walls interconnected by a pair of sidewalls, first slider means connected with an outer end portion of a first one of said boom sections and disposed in engagement with the bottom wall of a second one of said boom sections for at least partially supporting said second boom section for axial movement relative to said first boom section, second slider means connected with an inner end portion of said second boom section and disposed in engagement with an inner surface of the top wall of said first boom section, said second slider means being movable along a longitudinally extending path upon axial movement between said first and second boom sections, means defining an opening in said top wall of said first boom section, said opening extending through inner surface of said top wall of said first boom section and at least partially disposed in the path of movement of said second slider means, and cover means movable between a closed position blocking said opening in said top wall of said first boom section and an open position in which said second slider means is accessible from outside of said first boom section through said opening, said cover means including surface means which forms a continuation of the inner surface of said first boom section when said cover means is in said closed position.

12. A boom assembly as set forth in claim 11 wherein said first slider means includes means for applying a first force to said bottom wall of said second boom section and means for applying a second force to said bottom wall of said second boom section, said first and second forces having lines of action which intersect at a point above a plane which contains the central longitudinal axis of said second boom section and which extends perpendicular to a vertical plane, said second slider means including means for applying a third force to said top wall of said second boom section and means for applying a fourth force to said top wall of said second boom section, said third and fourth forces having lines of action which intersect at a point below the plane which contains the central longitudinal axis of said second boom section and which extends perpendicular to a vertical plane.

13. A boom assembly as set forth in claim 11 wherein said top wall of said second boom section includes a pair of interconnected longitudinally extending top plate sections which extend upwardly from sidewalls of said second boom section and intersect at a top peak, said top plate sections having major side surfaces which extend at an acute angle to a plane which contains the central longitudinal axis of said second boom section and extends perpendicular to a vertical plane, said bottom wall including a pair of interconnected longitudinally extending bottom plate sections which extend downwardly from said sidewalls of said second boom section and intersect at a bottom peak, said bottom bottom plate sections having major side surfaces which extend at an acute angle to the plane which contains the central longitudinal axis of said boom and extends perpendicular to a vertical plane.

14. A boom assembly comprising a plurality of longitudinally extending boom sections which are disposed in a telescopic relationship with each other and which are axially movable relative to each other to vary the telescopic relationship between said boom sections, said boom sections having top and bottom walls inter-connected by a pair of side walls, first and second slider means for applying first and second forces to spaced apart portions of said bottom wall of said one boom section, said first and second forces having lines of action which extend generally perpendicular to the associated portions of said bottom wall of said one boom section, said lines of action of said first and second forces having a first point of intersection, and third and fourth slider means for applying third and fourth forces to spaced apart portions of said top wall of said one boom section, said third and fourth forces having lines of action which extend generally perpendicular to the associated portions of said top wall of said one boom section, said lines of action of said third and fourth forces having a second point of intersection which is below a plane which contains said first point of intersection, extends parallel to the central axis of said second boom section, and extends perpendicular to a vertical plane.

15. A boom assembly as set forth in claim 14 wherein said first and second slider means includes a slider pad having a bearing surface disposed in flat abutting engagement with said bottom wall, said bearing surface including a first portion which is subjected to a relatively high stress upon loading of said boom assembly and a second portion which is subjected to a relatively low stress upon loading of said boom assembly.

16. A boom assembly as set forth in claim 14 wherein a second boom section which telescopically receives said one boom section includes longitudinally extending inner surface means for engaging said third and fourth slider means during axial movements between said boom sections, means defining an opening in said second boom section extending through said longitudinally extending inner surface means of said second boom section and at least partially disposed in a path of movement of at least one of said third and fourth slider means along said longitudinally extending inner surface of said second boom section, and releasable cover means movable between a closed position blocking said opening in said second boom section and an open position in which at least one of said third and fourth slider means is accessible from outside of said second boom section through said opening, said releasable cover means including surface means which forms a continuation of said longitudinally extending inner surface of said second boom section when said cover means is in said closed position.

17. A boom assembly as set forth in claim 14 wherein a second boom section which telescopically receives said one boom section includes a longitudinally extending top wall formed of a first material, a pair of spaced apart parallel strips of a second material which is harder than said first material, said pair of strips being secured to said top wall of said second boom section, said third and fourth slider means each including surface means movable along an associated one of said strips of a second material upon axial movement between said boom sections.

18. A boom assembly as set forth in claim 14 wherein bottom wall of said one boom section is formed of a first material, said one boom section including a pair of spaced apart parallel strips of a second material which is harder than said first material, said pair of strips being secured to an outer surface of said bottom wall, said first and second slider means each including surface means movable along an associated one of said strips of a second material upon axial movement between said boom sections.

19. A boom assembly as set forth in claim 14 wherein said top wall includes a pair of interconnected longitudinally extending top plate sections which extend upwardly from said side walls and intersect at a top peak, said top plate sections having major side surfaces which extend at acute angles to said plane which contains the central longitudinal axis of said one boom section and which extends perpendicular to a vertical plane, said bottom wall including a pair of interconnected longitudinally extending plate sections which extend downwardly from said side walls and intersect at a bottom peak, said bottom plate sections having major side surfaces which extend at acute angles to said plane which contains the central longitudinal axis of said one boom section and which extends perpendicular to a vertical plane.

20. A boom assembly as set forth in claim 19 wherein said first and second points of intersection lie in a plane extending through said top and bottom peaks.

* * * * *

UNITED STATES PATENT AND TRADEMARK OFFICE

CERTIFICATE OF CORRECTION

PATENT NO. : 4,038,794
DATED : August 2, 1977
INVENTOR(S) : Warren C. Young

It is certified that error appears in the above-identified patent and that said Letters Patent are hereby corrected as shown below:

Column 19,line 26, delete "bottom".

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*